United States Patent [19]

Fitzgerald

[11] Patent Number: 4,964,635

[45] Date of Patent: Oct. 23, 1990

[54] TENNIS RACKET

[76] Inventor: Gary C. Fitzgerald, 22 Francis St., Westfield, Mass. 01085

[21] Appl. No.: 337,899

[22] Filed: Apr. 14, 1989

[51] Int. Cl.[5] ..... A63B 49/02

[52] U.S. Cl. ..... 273/73 C; 273/73 R; 273/73 G

[58] Field of Search ..... 273/73 R, 73 C, 73 D, 273/73 E, 73 F, 73 G, 73 H, 73 K, 73 L

[56] References Cited

U.S. PATENT DOCUMENTS

| | | | |
|---|---|---|---|
| 4,141,551 | 2/1979 | Göransson | 273/73 G |
| 4,291,574 | 9/1981 | Frolow | 273/73 C |
| 4,322,076 | 3/1982 | Bertram et al. | 273/73 D |
| 4,798,382 | 1/1989 | Janes | 273/73 C |
| 4,834,383 | 5/1989 | Woehrle et al. | 273/73 C |

FOREIGN PATENT DOCUMENTS

| | | | |
|---|---|---|---|
| 0275805 | 7/1988 | European Pat. Off. | 273/73 R |
| 14247 | of 1884 | United Kingdom | 273/73 H |
| 14576 | of 1885 | United Kingdom | 273/73 H |
| 8324 | of 1887 | United Kingdom | 273/73 G |

OTHER PUBLICATIONS

The Sporting Good Dealer, "Quadrangular Racket Extends Sweet Spot", p. 112, Jun. 1988.

*Primary Examiner*—Benjamin Layno

[57] ABSTRACT

A tennis racket comprised of a handle connected to a frame with a wide open throat, a wide inverted bridge, and an open, tensioned string receiving, playing head. The longitudinal strings successively increase in length outward from the longitudinal axis and the transverse strings successively increase in length outward from the handle. The results of which are an increase in racket stability, an enlarged optimum spring back area, increasing in size outward toward the sides and upward toward the tip, the center of percussion located closer to the geometric center of the head, and the vibration levels on off-center hits being reduced.

4 Claims, 2 Drawing Sheets

TENNIS RACKET

BACKGROUND

1. Field of Invention

This invention relates to tennis rackets comprised of a handle connected to a frame with an open, tensioned string receiving, playing head.

2. Description of Prior Art

Most tennis rackets in use today have a generally oval or elliptical playing head, of which the longitudinal strings successively decrease in length outward from the longitudinal axis, and the transverse strings successively decrease in length from the center of the head to the tip. One disadvantage of this type of racket is that the optimum spring back area is relatively small compared to the size of the playing area, and is located considerably off-center, longitudinally, toward the handle. A ball hitting outward or upward from this optimum spring back area has a low spring back effect, and is difficult to control, due to the excessive vibration from the successively shorter and stiffer strings. Another disadvantage of this type of racket is that the oval or elliptical head, narrowing toward the tip, does not conform to where a ball hits the playing area when it is hit far off-center. A ball will generally hit farther from the longitudinal axis the farther it is hit from the handle. The narrow concave throat shape is another disadvantage of a conventional racket. With more mass located close to the longitudinal axis, the racket has a lower inertia or stability. When a ball hits outward from the longitudinal axis the racket twists in the hand, resulting in a loss of power and control, and possibly contributing to the ailment known as "tennis elbow".

Through the drawing of Goransson U.S. Pat. No. 4,141,551 (1979), it seems to be known to make a tennis racket where at least a central portion of the longitudinal strings successively increase in length outward from the longitudinal axis. However, the transverse strings successively decrease in length from the center of the head to the tip, and the frame and head are of conventional design. The result is a racket of low stability, and the optimum spring back area and center of percussion are located considerably off-center, longitudinally, toward the handle.

Through the drawings of Townsend U.K. Pat. No. 14,576 (1885), it seems to be known to make a tennis racket where at least a central portion of the longitudinal strings successively increase in length outward from the longitudinal axis, and a substantial portion of the transverse strings successively increase in length outward from the handle. However, the longitudinal strings successively increase in length in a relatively narrow central portion of the head, and the longest longitudinal strings are only about 3% longer than the longitudinal strings closest to the longitudinal axis. The result is a racket with a minimum increase in the size of the optimum spring back area. The design of the frame, with a very long handle shaft and solid throat and bridge, locates most of the mass close to the longitudinal axis. The result is a racket of low stability, and the center of percussion located considerably off-center, longitudinally, toward the handle.

OBJECTS AND ADVANTAGES

The intent of the present invention is to obtain a racket with advantageous playing characteristics above those currently in use. A main objective is to provide an enlarged area of optimum spring back effect, increasing outward from the longitudinal axis and upward toward the tip. Another objective is to reduce the vibration levels on off-center hits. According to the invention these objectives are obtained by providing a racket where a substantial portion of the longitudinal strings successively increase in length outward from the longitudinal axis, and a substantial portion of the transverse strings successively increase in length outward from the handle. Other objectives are to increase the stability, or resistance to twisting on off-center hits, and to locate the center of percussion, the area of highest spring back effect and lowest vibration, closer to the geometric center of the playing area. These objectives are obtained by providing a frame with a wide, substantially V-shaped open throat, a wide inverted bridge, and a head that increases in width toward the tip. Another objective of the invention is to obtain a racket where off-center hits are less likely to hit the frame, without increasing the longitudinal and transverse axes lengths. This objective is obtained by providing a non-elliptical playing area that is approximately 30% larger than the playing area of a conventional racket with equal longitudinal and transverse axes.

A more detailed description of a preferred embodiment of the invention with accompanying drawings is provided below.

DRAWING FIGURES

In the drawings, closely related figures have the same number but different suffixes.

DESCRIPTION—FIGURES 1–4

Figure 1:
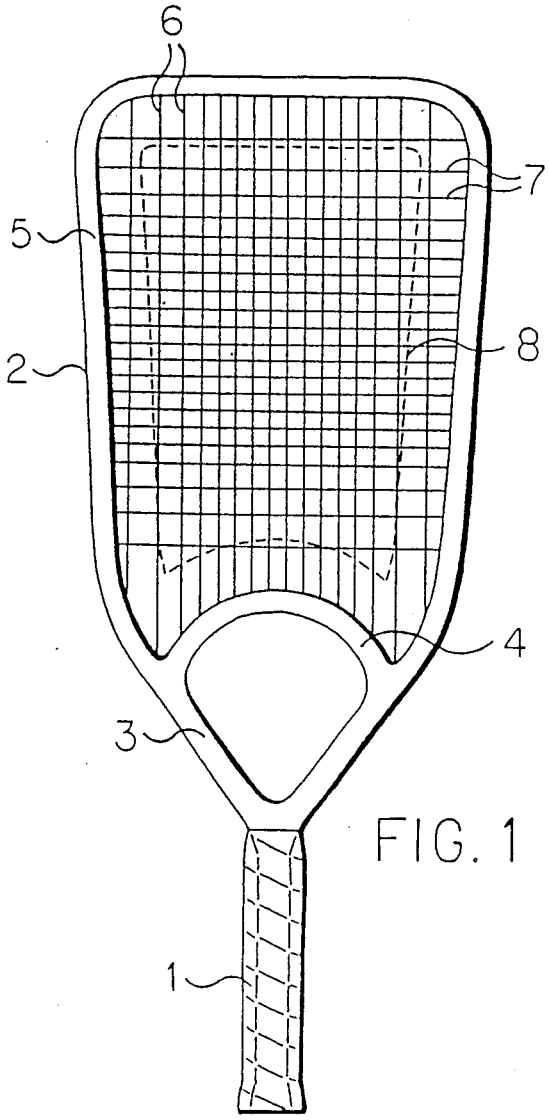
FIG. 1 is a plan view of a tennis racket in accordance with the present invention.

As shown in FIG. 1 of the drawings, the improved racket is comprised of a handle 1 connected to a frame 2 with a wide, substantially V-shaped open throat 3, a wide, inverted bridge 4, and an open, tensioned string receiving, head 5. The longitudinal strings 6, of a substantial central portion, successively increase in length outward from the longitudinal axis, and the transverse strings 7, of a substantial portion, successively increase in length outward from the handle. The longest longitudinal strings are approximately 15% longer than the longitudinal strings closest to the longitudinal axis. FIG. 1 shows the longitudinal strings successively increasing in length outward from the longitudinal axis and the transverse strings successively increasing in length outward from the handle, throughout the effective hitting area 8. The effective hitting area being the area at least $1\frac{1}{4}$ inches inward from the frame, whereas the ineffective hitting area, within $1\frac{1}{4}$ inches of the frame, is where a ball hits the frame or has virtually no spring back effect.

Figure 2:
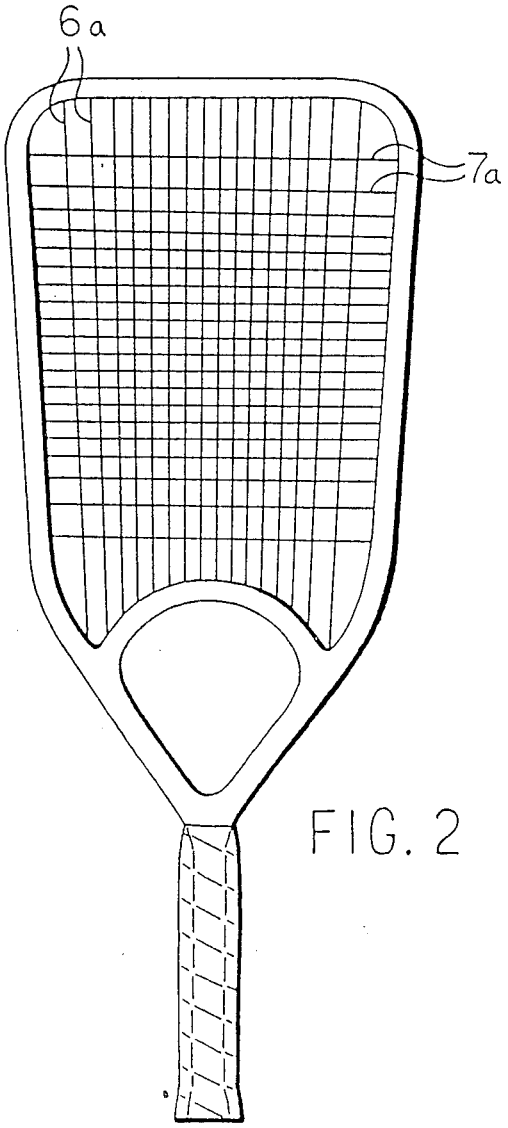
FIG. 2 is a plan view of a tennis racket similar to FIG. 1 but showing a modified string pattern.

As shown in FIG. 2, the placement or pattern of strings can be modified so that all of the longitudinal strings **6*a* successively increase in length outward from the longitudinal axis and all of the transverse strings 7*a*** successively increase in length outward from the handle, throughout the entire playing area. The longitudinal strings, of at least an outward portion, angle outward from the longitudinal axis in a direction from the handle toward the tip.

In a preferred embodiment of the invention, the frame is of a one-piece molded design made of a composite material such as graphite, fiberglass, aramid, or other types of fibers bonded with a high strength resin such as epoxy. The frame could also be made of other materials such as aluminum and plastics. The length, weight, balance, stiffness, cross section, size of the playing head, and other variables can be built to accommodate different players and their different needs. The means of stringing and grip wrapping would use standard materials and applications that are used on current rackets.

Figure 3:
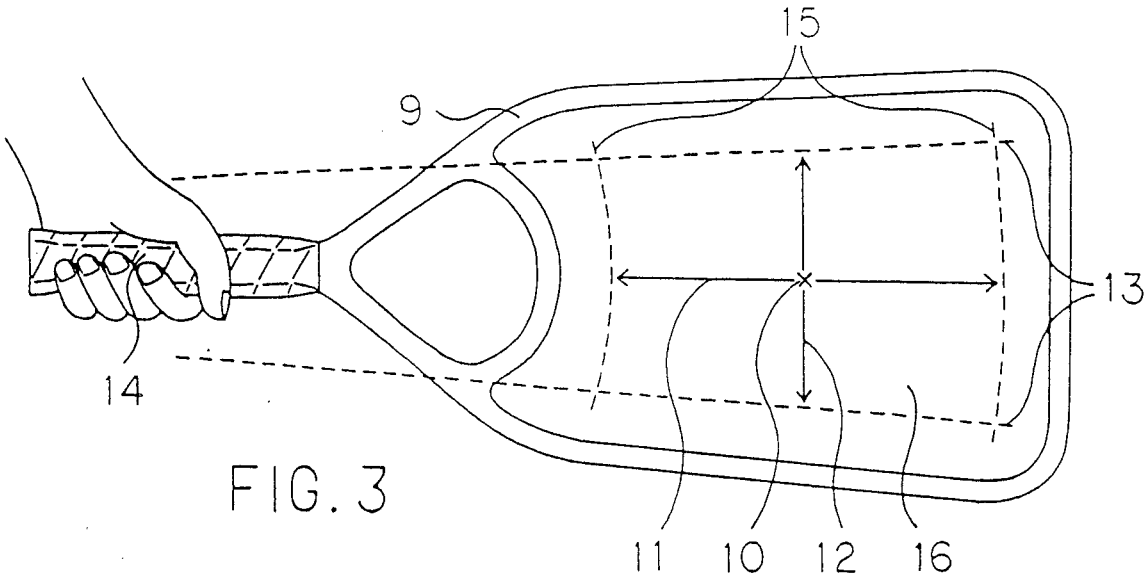
FIG. 3 is a diagrammatic view of the present racket held by a hand.

As shown in FIG. 3 of the invention 9, a ball hits outward from the geometric center 10 of the head longitudinally 11, toward the handle and toward the tip, and transversely 12, outward from the longitudinal axis. The "transverse error zone" 13, the distance outward from the longitudinal axis where a ball hits, increases the farther the distance from the grip 14. The "longitudinal error zone" 15, the distance outward from the transverse axis where a ball hits, is a substantially constant distance on an arc from the grip. The total "error zone" 16, the intersection of the longitudinal and transverse error zones, is where a ball hits virtually all of the time. The present invention has a head consisting of a wide inverted bridge, substantially linear sides that angle outward from the longitudinal axis in a direction from the handle toward the tip, and a substantially linear tip transverse to the longitudinal axis. This head shape conforms to the previously described error zone while a conventional oval or elliptical head does not. The error zone will vary in size from player to player due to different skill levels but the shape will generally remain the same. The invention can have larger or smaller hitting areas to accommodate players of different skill levels.

Figure 4:
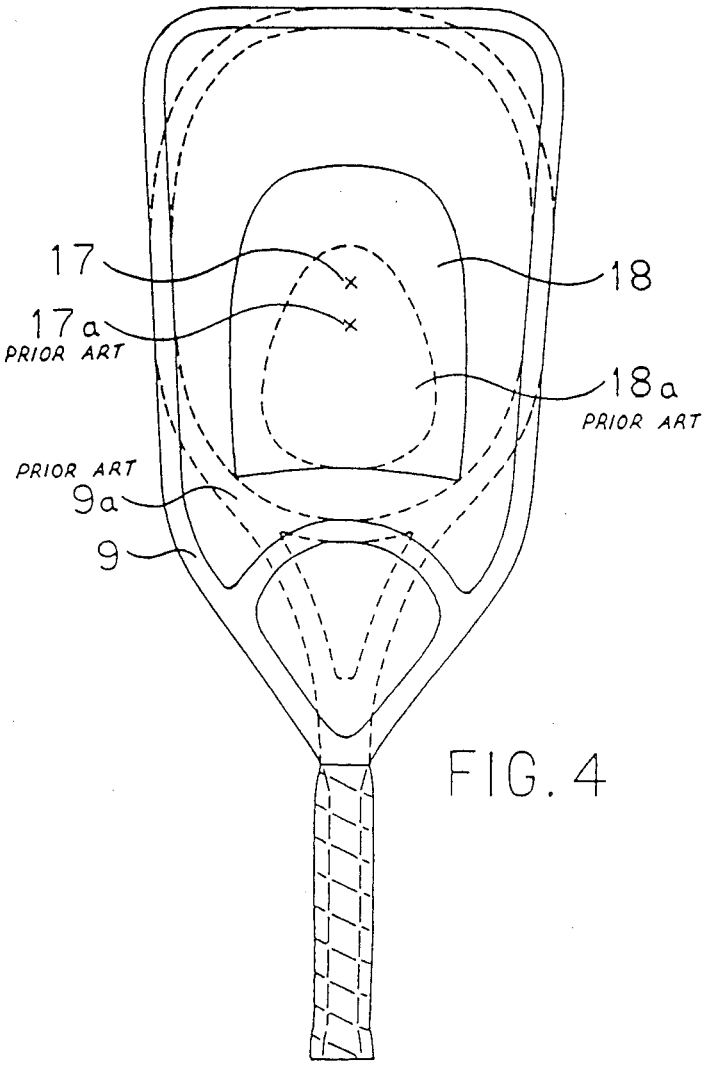
FIG. 4 is a diagrammatic comparison of the present invention and a conventional racket of prior art.

As shown in FIG. 4 of the drawings, the invention 9 has more mass outward from the longitudinal axis, at the throat, bridge, and tip areas, than a conventional racket 9*a*. This increases the inertia or stability of the racket and moves the center of percussion 17 of the invention closer to the geometric center of the playing head than the center of percussion 17*a* of a conventional racket. The optimum spring back area 18 of the invention is increased outward and upward from the optimum spring back area 18*a* of a conventional racket due to the longitudinal strings successively increasing in length outward from the longitudinal axis, the transverse strings successively increasing in length outward from the handle, and the increased stability of the frame.

My above description should not be construed as a limitation on the scope of the invention, but rather as an exemplification of a preferred embodiment thereof. Other variations are possible, such as the throat, sides of the head, and tip portions of the frame being of a curved shape rather than linear. Therefore the scope of the invention should be determined by the appended claims and their legal equivalents.

I claim:

1. In a tennis racket comprised of a handle connecting to a frame, providing an open playing head having a first set of strings spanning in a substantially longitudinal direction interlaced with a second set of strings spanning in a substantially transverse direction, the improvements characterized by: means of a substantially V-shaped open throat and inverted open bridge connecting to said open playing head; and means embodied in said frame for mounting a plurality of longitudinal strings in such a manner that they successively increase in length outward from the longitudinal axis, and a plurality of transverse strings in such a manner that they successively increase in length from the geometric center of the head toward the tip, whereby the improvements provide an enlarged area of optimum spring back effect extending outward toward the sides of the head and upward toward the tip, an increase in the stability of the of the racket, the center of percussion located closer to the geometric center of the head, and the vibration levels on off-center hits being reduced.

2. A tennis racket as in claim 1 wherein the longitudinal strings successively increase in length outward from the longitudinal axis throughout the effective hitting area, and the transverse strings successively increase in length from the handle to the tip throughout the effective hitting area, the effective hitting area being the area at least $1\frac{1}{4}$ inches inward from the frame.

3. A tennis racket as in claim 1 wherein the longitudinal strings successively increase in length outward from the longitudinal axis throughout the entire head, the longitudinal strings of at least an outward portion, angle outward from the longitudinal axis in a direction from the handle toward the tip.

4. A tennis racket as in claim 2 wherein the longitudinal strings successively increase in length outward from the longitudinal axis throughout the entire head, the longitudinal strings of at least an outward portion, angle outward from the longitudinal axis in a direction from the handle toward the tip.

* * * * *